US005678259A

United States Patent [19]

Cruz Jr.

[11] Patent Number: 5,678,259

[45] Date of Patent: Oct. 21, 1997

[54] FOOT WASHING SYSTEM

[75] Inventor: Tarzo Cruz Jr., Parsippany, N.J.

[73] Assignee: Tarzo Cruz, Parsippany, N.J.

[21] Appl. No.: 626,840

[22] Filed: Apr. 2, 1996

[51] Int. Cl.[6] ..... A47K 3/022

[52] U.S. Cl. ..... 4/622; 15/104.92

[58] Field of Search ..... 4/622; 15/104.92, 15/160, 161

[56] References Cited

U.S. PATENT DOCUMENTS

| | | | |
|---|---|---|---|
| 2,809,406 | 10/1957 | Walter | 15/161 X |
| 3,548,439 | 12/1970 | Berst . | |
| 3,911,520 | 10/1975 | Tupper | 15/104.92 |
| 4,003,372 | 1/1977 | Willoby . | |
| 4,485,503 | 12/1984 | Rolando et al. . | |
| 4,520,525 | 6/1985 | Yogi et al. | 4/622 X |
| 5,173,972 | 12/1992 | Goodman . | |
| 5,321,867 | 6/1994 | Probst . | |

FOREIGN PATENT DOCUMENTS

| | | | |
|---|---|---|---|
| 0802707 | 2/1951 | Germany | 4/622 |

*Primary Examiner*—Charles E. Phillips
*Attorney, Agent, or Firm*—Martin Keller

[57] ABSTRACT

A foot washing system includes a rectangular container that is separated into a first compartment, a second compartment, and a third compartment. The container has slots formed in opposing edges thereof. A lid is slidably received within the slots formed in the opposing edges of the open top of the container. A foot scrubbing mechanism is secured within the first compartment of the rectangular container. A foot washing mechanism is secured within the second compartment of the rectangular container. A foot drying mechanism is secured within the third compartment of the rectangular container.

9 Claims, 4 Drawing Sheets

FOOT WASHING SYSTEM

BACKGROUND OF THE INVENTION

1. Field of the Invention

The present invention relates to a foot washing system and more particularly pertains to cleaning, washing, and drying feet of a user with a foot washing system.

2. Description of the Prior Art

The use of foot washing is known in the prior art. More specifically, foot washing heretofore devised and utilized for the purpose of washing a user's feet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,321,867 to Probst discloses a foot washing apparatus.

U.S. Pat. No. 3,548,439 to Berst discloses a foot soaping and scrubbing device.

U.S. Pat. No. 5,173,972 to Goodman discloses an automatic foot washer.

U.S. Pat. No 4,485,503 to Rolando et al. discloses an automatic foot washing apparatus.

U.S. Pat. No. 4,003,372 to Willoby discloses a foot washing and massaging device.

While these devices fulfill their respective, particular objective and requirements, the aforementioned patents do not describe a foot washing system for cleaning, washing, and drying feet of a user.

In this respect, the foot washing system according to the present invention substantially departs from the conventional concepts and designs of the prior art, and in doing so provides an apparatus primarily developed for the purpose of cleaning, washing, and drying feet of a user.

Therefore, it can be appreciated that there exists a continuing need for new and improved foot washing system which can be used for cleaning, washing, and drying feet of a user. In this regard, the present invention substantially fulfills this need.

SUMMARY OF THE INVENTION

In the view of the foregoing disadvantages inherent in the known types of foot washing now present in the prior art, the present invention provides an improved foot washing system. As such, the general purpose of the present invention, which will be described subsequently in greater detail, is to provide a new and improved foot washing system and method which has all the advantages of the prior art and none of the disadvantages.

To attain this, the present invention essentially comprises a rectangular container having an open top, a closed bottom, a front wall, a rear wall, and two side walls. The rectangular container is separated into a first compartment, a second compartment, and a third compartment. The open top has slots formed in opposing edges thereof. A lid having a planar rectangular configuration is slidably received within the slots formed in the opposing edges of the open top of the container. A front end of the lid has a wheel support secured thereto. A back end of the lid has a stop mechanism secured thereto. An upper surface of the lid has a sliding handle disposed thereon. A foot scrubbing mechanism is secured within the first compartment of the rectangular container. The foot scrubbing mechanism includes a pair of hook and loop fasteners secured to the closed bottom thereof. A piece of rug is dimensioned for receipt within the first compartment. The piece of rug has a pair of hook and loop fasteners on a back surface thereof corresponding with the pair of hook and loop fasteners of the first compartment for coupling therewith. A foot washing mechanism is secured within the second compartment of the rectangular container. The foot washing mechanism includes a lower sponge secured to the closed bottom of the second compartment. The foot washing mechanism also includes a water bottle having a pair of flexible posts extending from a lower end thereof. The flexible posts are secured to the closed bottom of the second compartment inwardly of a front wall thereof. A plurality of perforated hoses extend outwardly of the lower end of the water bottle. The plurality of perforated hoses extend to be disposed upon the lower sponge. An upper sponge is disposed over the plurality of perforated hoses upon the lower sponge. A water sprayer has a lead line extending inwardly of a side wall of the water bottle. A foot drying mechanism is secured within the third compartment of the rectangular container. The foot drying mechanism includes a pair of rolling pins rotatably secured between side walls thereof. A circular towel is coupled around the pair of rolling pins. A sponge is secured to the closed bottom of the third compartment disposed between the pair of rolling pins and under the circular towel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot washing system which has all the advantages of the prior art foot washing and none of the disadvantages.

It is another object of the present invention to provide a new and improved foot washing system which may be easily and efficiently manufactured and marketed.

It is a further object of the present invention to provide a new and improved foot washing system which is of durable and reliable construction.

An even further object of the present invention is to provide a new and improved foot washing system which is susceptible of a low cost of manufacture with regard to both materials and labor, and which accordingly is then susceptible of low prices of sale to the consuming public, thereby making such a foot washing system economically available to the buying public.

Still yet another object of the present invention is to provide a new and improved foot washing system which provides in the apparatuses and methods of the prior art some of the advantages thereof, while simultaneously overcoming some of the disadvantages normally associated therewith.

Even still another object of the present invention is to provide a new and improved foot washing system for cleaning, washing, and drying feet of a user.

Lastly, it is an object of the present invention to provide a new and improved foot washing system includes a rectangular container that is separated into a first compartment, a second compartment, and a third compartment. The container has slots formed in opposing edges thereof. A lid is slidably received within the slots formed in the opposing edges of the open top of the container. A foot scrubbing mechanism is secured within the first compartment of the rectangular container. A foot washing mechanism is secured within the second compartment of the rectangular container. A foot drying mechanism is secured within the third compartment of the rectangular container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
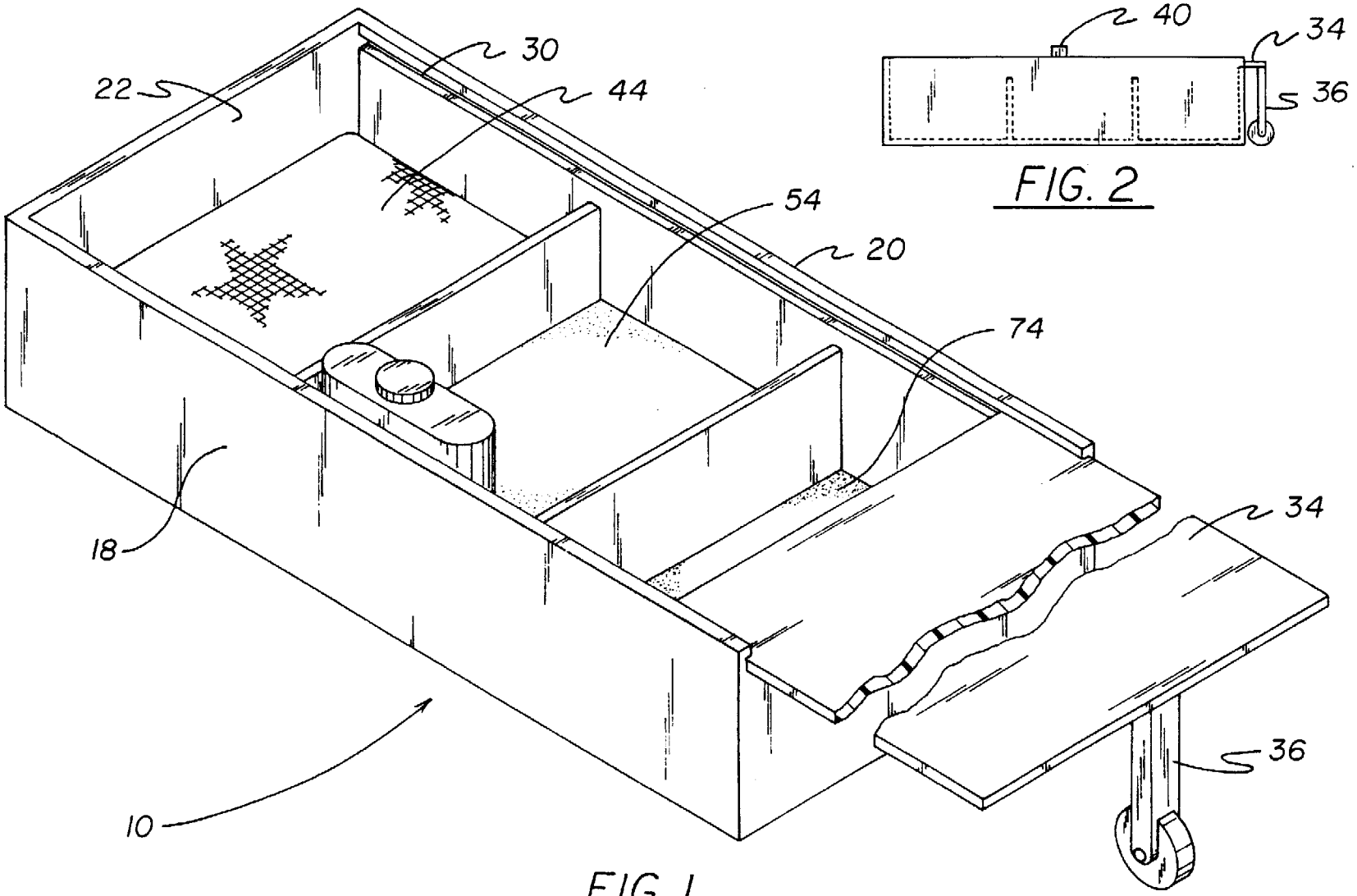
FIG. 1 is a perspective view of the preferred embodiment of the foot washing system constructed in accordance with the principles of the present invention.
FIG. 2 is a reduced side elevation view of the present invention.
Figure 3:
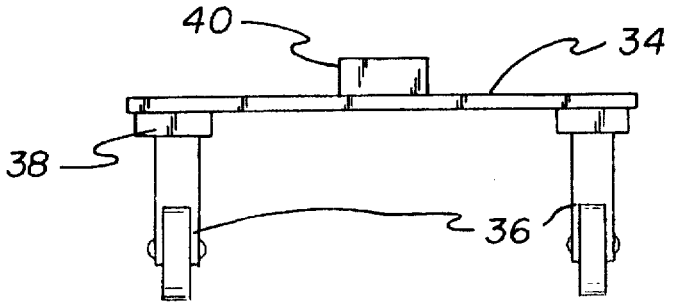
FIG. 3 is a front elevation view of the lid of the present invention.
Figure 4:
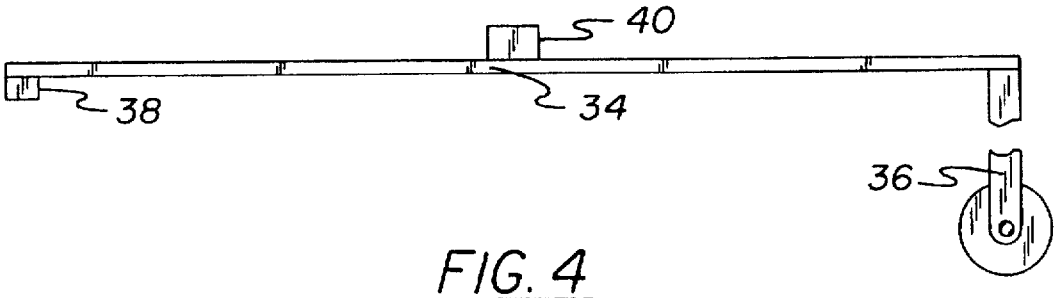
FIG. 4 is a side elevation view of the lid of the present invention.
Figure 5:
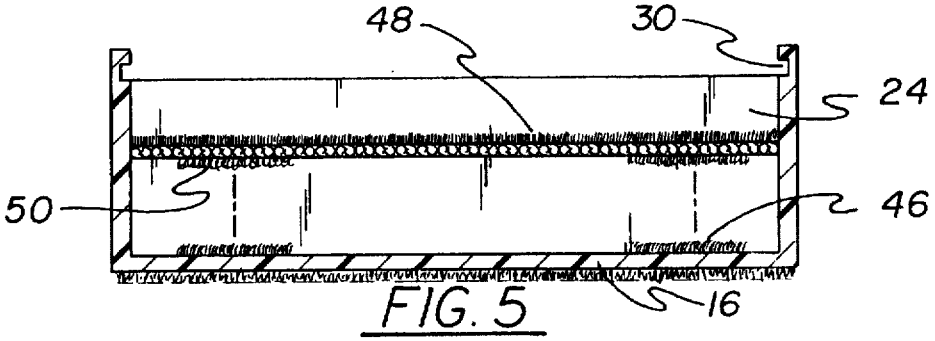
FIG. 5 is a side view of the first compartment of the present invention shown in cross-section.
Figure 6:
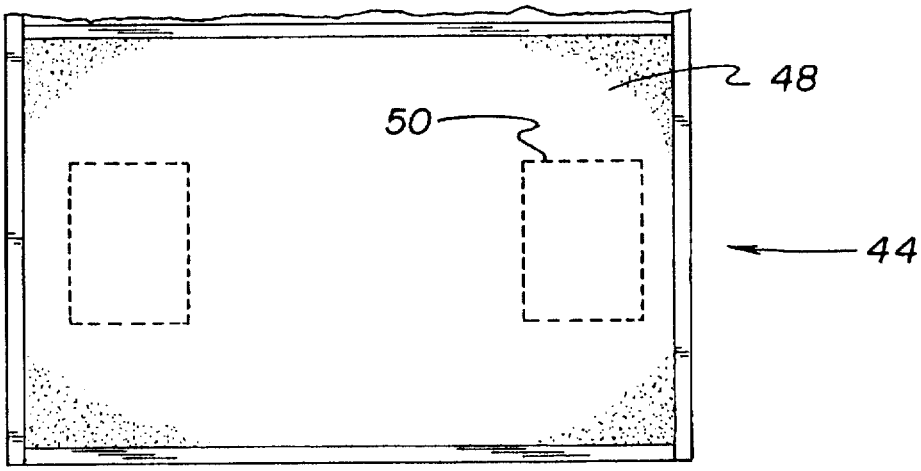
FIG. 6 is a plan view of the first compartment of the present invention.
Figure 7:
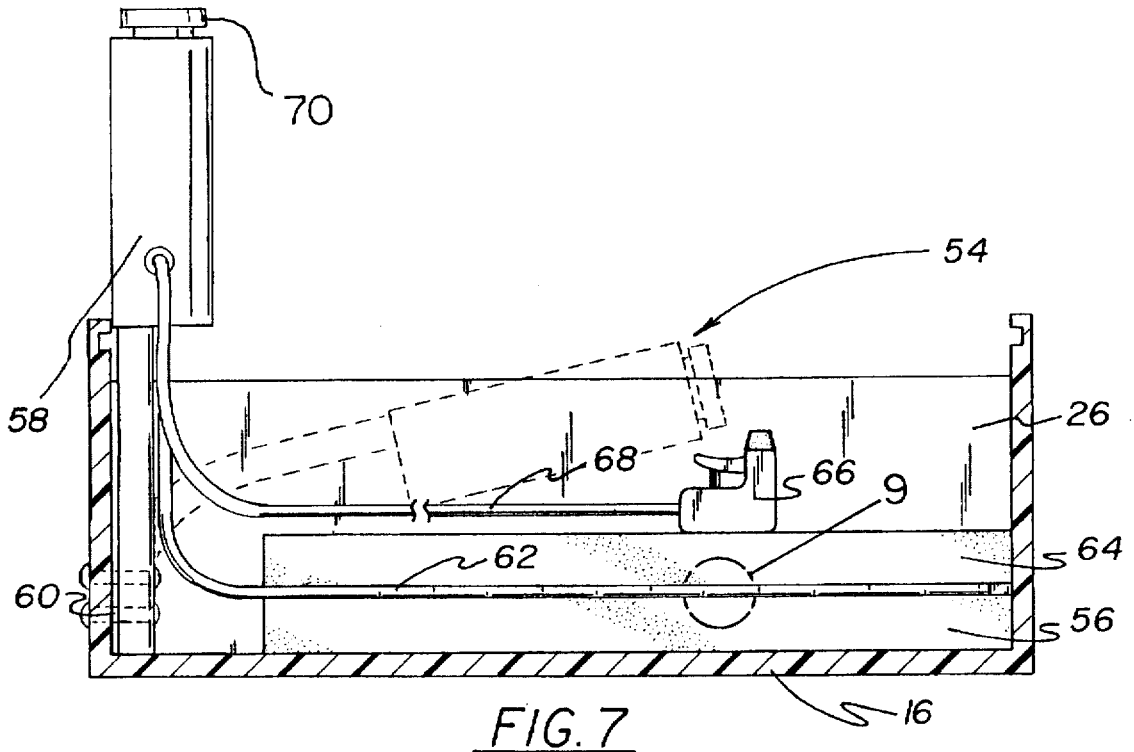
FIG. 7 is a side view of the second compartment of the present invention shown in cross-section.
Figure 8:
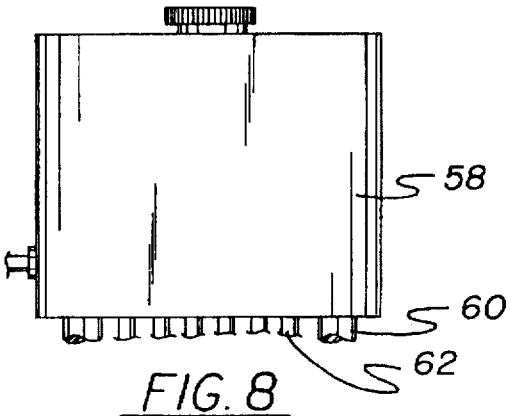
FIG. 8 is a front view of the water bottle of the present invention.
Figure 9A:
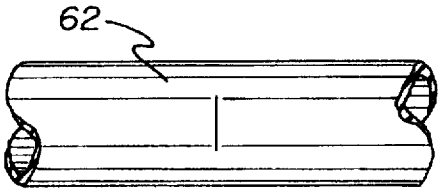
FIG. 9*a* is a side view of the water line of the water bottle of the present invention.
Figure 9B:
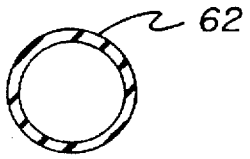
FIG. 9*b* is a front view of the water line of the water bottle of the present invention.
Figure 10A:
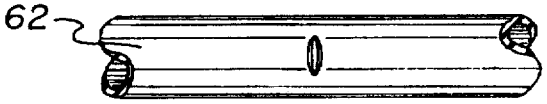
FIG. 10*a* is a side view of the water line of the water bottle as compressed of the present invention.
Figure 10B:
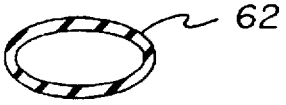
FIG. 10*b* is a front view of the water line of the water bottle as compressed of the present invention.

With reference now to the drawings, and in particular, to FIGS. 1–13 thereof, the preferred embodiment of the new and improved foot washing system embodying the principles and concepts of the present invention and generally designated by the reference number 10 will be described.

Specifically, it will be noted in the various Figures that the device relates to a new and improved foot washing system for cleaning, washing, and drying feet of a user. In its broadest context, the device consists of a rectangular container, a lid, a foot scrubbing mechanism, a foot washing mechanism, and a foot drying mechanism. Such components are individually configured and correlated with respect to each other so as to attain the desired objective.

The device 10 includes a rectangular container 12 having an open top 14, a closed bottom 16, a front wall 18, a rear wall 20, and two side walls 22. The rectangular container 12 is separated into a first compartment 24, a second compartment 26, and a third compartment 28. The open top 14 has slots 30 formed in opposing edges thereof. Each of the compartments 24,26,28 are of equal size and dimensions. The container 12 is made of a rigid, waterproof material that is also leakproof.

A lid 34 having a planar rectangular configuration is slidably received within the slots 30 formed in the opposing edges of the open top 14 of the container 12. A front end of the lid 34 has a pair of wheel supports 36 secured thereto. The wheel supports 36 facilitate the sliding back and forth of the lid 34 within the slots 30. A back end of the lid 34 has a stop mechanism 38 secured thereto. The stop mechanism 38 prevents the lid 34 from becoming disengaged from the slots 30. An upper surface of the lid 34 has a sliding handle 40 disposed thereon. The sliding handle 40 facilitates the movement of the lid 34 with the use of a user's foot.

A foot scrubbing mechanism 44 is secured within the first compartment 24 of the rectangular container 12. The foot scrubbing mechanism 44 includes a pair of hook and loop fasteners 46 secured to the closed bottom 16 thereof. A piece of rug 48 is dimensioned for receipt within the first compartment 24. The piece of rug 48 has a pair of hook and loop fasteners 50 on a back surface thereof corresponding with the pair of hook and loop fasteners 46 of the first compartment 24 for coupling therewith. The piece of rug 48 is used by a person placing their feet upon it and scraping their feet back and forth to remove debris stuck to the bottom of their feet. The hook and loop fasteners 46,50 allow the piece of rug 48 to be removed once it is soiled to be properly cleaned or replaced.

A foot washing mechanism 54 is secured within the second compartment 26 of the rectangular container 12. The foot washing mechanism 54 includes a lower sponge 56 secured to the closed bottom 14 of the second compartment 26. The foot washing mechanism 54 also includes a water bottle 58 having a pair of flexible posts 60 extending from a lower end thereof. The flexible posts 60 are secured to the closed bottom 14 of the second compartment 26 inwardly of a front wall thereof. The flexible posts 60 serves to bias the water bottle 58 to an upright position extending outwardly of the open top 14 of the second compartment 26. Once the lid 34 is placed over the open top 14 of the container, the lid 34 will push the water bottle 58 down to allow for proper storage. A plurality of perforated hoses 62 extend outwardly of the lower end of the water bottle 58. The plurality of perforated hoses 62 extend to be disposed upon the lower sponge 56. An upper sponge 64 is disposed over the plurality of perforated hoses 62 upon the lower sponge 56. A water sprayer 66 has a lead line 68 extending inwardly of a side wall of the water bottle 58. The water bottle 58 has a removable cap 70 thereon to allow water to be added when needed. A user stepping on the upper sponge 64 will cause the plurality of perforated hoses 62 to release water received from the water bottle to spread through the upper sponge 64 to wash the user's feet. The lead line 68 is of a significant length to allow the water sprayer 66 to be wielded and wash the feet of the user.

Figure 11:
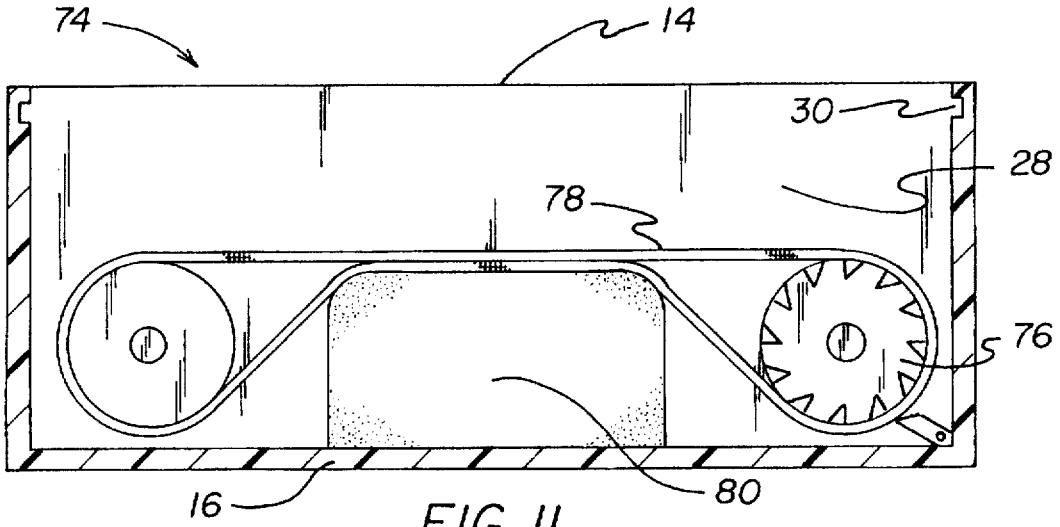
FIG. 11 is a side view of the third compartment of the present invention shown in cross-section.
Figure 12:
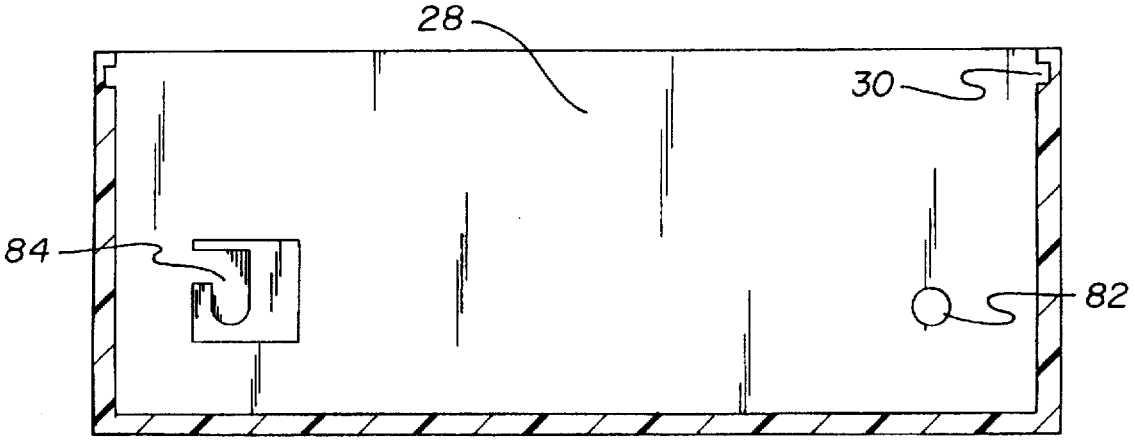
FIG. 12 is a side view of the third compartment of the present invention shown in cross-section.
Figure 13:
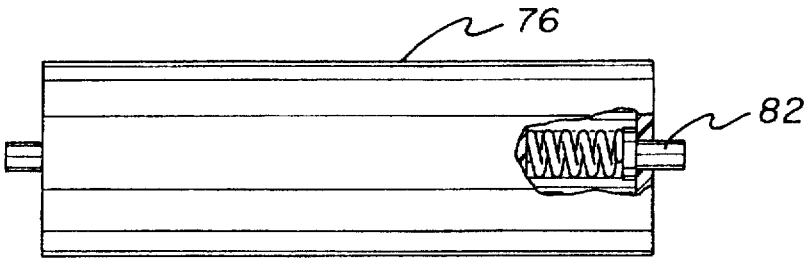
FIG. 13 is a front view of the rolling pin of the present invention.

A foot drying mechanism 74 is secured within the third compartment 28 of the rectangular container 12. The foot drying mechanism 74 includes a pair of rolling pins 76 rotatably secured between side walls thereof. A circular towel 78 is coupled around the pair of rolling pins 76. A sponge 80 is secured to the closed bottom 16 of the third compartment 28 disposed between the pair of rolling pins 76 and under the circular towel 78. The sponge 80 contours to the bottom of the feet allowing the user to dry their feet by shuffling the feet back and forth. Forward pressure on the front rolling pin 76 will move the circular towel 78 around the pins 76 until a clean section of the towel 78 is on top of the sponge 80. One of the rolling pins 76 having a spring-biased rod 82 therein to facilitate removal of the rolling pin 76 from a holding aperture 82 within the side walls of the third compartment 28. The other rolling pin 76 secured within an L-shaped holding bracket 84 secured on the side walls of the third compartment 28. The L-shaped holding bracket 84 and the spring-biased rod 82 allows for the pair of rolling pins 76 to be removed to allow the circular towel 78 to be removed from the pair of rolling pins 76 to be cleaned or replaced. FIG. 11 illustrates a rear rolling pin 76 having ½ inch wide triangular notches formed therein spaced about ½ inches between one another. A catch post is secured in a corner of the base to extend to couple with one of the notches.

The device 10 could also be constructed as a portable unit with similar features with a few variations. This unit is in three compartments and each compartment is ¼ inch smaller than the unit size described above. The unit will lay flat with side hinges (one on each side of each compartment). The hinges vary in size to accommodate the closing of the unit. This unit will close upright. When closing, the foot washing compartment will be the base. The foot scrubbing compartment will swing on top of the foot washing compartment and the foot drying compartment will swing on top of the foot washing compartment. Each compartment will have its own separate lid. Lid openings will vary but will use the same principle as the unit above. The foot scrubbing compartment will open with the heel catch from right to left with one wheel balancing on the center of the left side of the lid. The foot washing compartment will open by sliding forward. The grooves will be on the insides of the center compartment with one balanced wheel in the center for opening in a forward motion rather than side to side. The foot drying compartment will open with the heel catch from left to right, with the grooves being on the top and bottom of the unit as with the foot scrubbing compartment and will have one balance wheel in the center part of the lid on the right side. The heel catch is described as half moon, one inch high and ½ inch thick. When the unit is stacked (closed), each unit will be 1½ inches above each other allowing for clearance of heel catches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A foot washing system comprising:

a rectangular container being separated into a first compartment, a second compartment, and a third compartment, the container having slots formed in opposing edges thereof;

a lid slidably received within the slots formed in the opposing edges of the open top of the container;

a foot scrubbing mechanism secured within the first compartment of the rectangular container;

a foot washing mechanism secured within the second compartment of the rectangular container;

a foot drying mechanism secured within the third compartment of the rectangular container.

2. The system as set forth in claim 1 wherein the foot drying mechanism including a pair of rolling pins rotatably secured between side walls thereof, a circular towel coupled around the pair of rolling pins, a sponge secured to the closed bottom of the third compartment disposed between the pair of rolling pins and under the circular towel.

3. The system as set forth in claim 1 wherein a front end of the lid having a pair of wheel supports secured thereto.

4. The system as set forth in claim 1 wherein a back end of the lid having a stop mechanism secured thereto.

5. The system as set forth in claim 1 wherein an upper surface of the lid having a sliding handle disposed thereon.

6. The system as set forth in claim 1 wherein the foot scrubbing mechanism including a pair of hook and loop fasteners secured to a closed bottom thereof, a piece of rug dimensioned for receipt within the first compartment, the piece of rug having a pair of hook and loop fasteners on a back surface thereof corresponding with the pair of hook and loop fasteners of the first compartment for coupling therewith.

7. The system as set forth in claim 1 wherein the foot washing mechanism including a lower sponge secured to a closed bottom of the second compartment, the foot washing mechanism also including a water bottle having a pair of flexible posts extending from a lower end thereof, the flexible posts secured to the closed bottom of the second compartment inwardly of a front wall thereof, a plurality of perforated hoses extending outwardly of the lower end of the water bottle, the plurality of perforated hoses extending to be disposed upon the lower sponge, an upper sponge disposed over the the plurality of perforated hoses upon the lower sponge.

8. The system as set forth in claim 7 and further including a water sprayer having a lead line extending inwardly of a side wall of the water bottle.

9. A foot washing system for cleaning, washing, and drying feet of a user comprising, in combination:

a rectangular container having an open top, a closed bottom, a front wall, a rear wall, and two side walls, the rectangular container being separated into a first compartment, a second compartment, and a third compartment, the open top having slots formed in opposing edges thereof;

a lid having a planar rectangular configuration slidably received within the slots formed in the opposing edges of the open top of the container, a front end of the lid having a pair of wheel supports secured thereto, a back end of the lid having a stop mechanism secured thereto, an upper surface of the lid having a sliding handle disposed thereon;

a foot scrubbing mechanism secured within the first compartment of the rectangular container, the foot scrubbing mechanism including a pair of hook and loop fasteners secured to the closed bottom thereof, a piece of rug dimensioned for receipt within the first compartment, the piece of rug having a pair of hook and loop fasteners on a back surface thereof corresponding with the pair of hook and loop fasteners of the first compartment for coupling therewith;

a foot washing mechanism secured within the second compartment of the rectangular container, the foot washing mechanism including a lower sponge secured to the closed bottom of the second compartment, the foot washing mechanism also including a water bottle having a pair of flexible posts extending from a lower end thereof, the flexible posts secured to the closed bottom of the second compartment inwardly of a front wall thereof, a plurality of perforated hoses extending outwardly of the lower end of the water bottle, the plurality of perforated hoses extending to be disposed upon the lower sponge, an upper sponge disposed over the plurality of perforated hoses upon the lower sponge, a water sprayer having a lead line extending inwardly of a side wall of the water bottle;

a foot drying mechanism secured within the third compartment of the rectangular container, the foot drying mechanism including a pair of rolling pins rotatably secured between side walls thereof, a circular towel coupled around the pair of rolling pins, a sponge secured to the closed bottom of the third compartment disposed between the pair of rolling pins and under the circular towel.

* * * * *